US005960892A

United States Patent [19]

Balve et al.

[11] Patent Number: 5,960,892

[45] Date of Patent: Oct. 5, 1999

[54] AUTOMATICALLY DRIVEN PILE DRIVER DRILLING DEVICE

[75] Inventors: Gerhard Balve; Franz-Josef Puttmann; Alfons Hesse, all of Lennestadt, Germany

[73] Assignee: Tracto-Technik Paul Schmidt Spezialmaschinen, Lennestadt, Germany

[21] Appl. No.: 08/697,410

[22] Filed: Aug. 23, 1996

[30] Foreign Application Priority Data

Aug. 23, 1995 [DE] Germany ..... 195 30 972

[51] Int. Cl.[6] ..... B25D 9/00

[52] U.S. Cl. ..... 173/91; 175/19

[58] Field of Search ..... 173/91, 17, 137, 173/138, 73; 175/19, 296

[56] References Cited

U.S. PATENT DOCUMENTS

| | | | |
|---|---|---|---|
| 4,078,619 | 3/1978 | Sudnishnikov | 175/19 |
| 4,171,727 | 10/1979 | Tkach | 175/19 |
| 4,214,638 | 7/1980 | Sudnishnikov | 173/1 |
| 4,250,972 | 2/1981 | Schmidt | 173/91 |
| 4,295,533 | 10/1981 | Schmidt | 175/19 |
| 4,683,960 | 8/1987 | Kostylev | 173/91 |
| 4,708,211 | 11/1987 | Shemyakin | 175/19 |
| 4,953,626 | 9/1990 | Puttmann | 173/91 |
| 5,327,636 | 7/1994 | Wilson | 173/91 |

FOREIGN PATENT DOCUMENTS

| | | |
|---|---|---|
| 0 484 839 | 5/1992 | European Pat. Off. . |
| 34 37 226 | 4/1986 | Germany . |

*Primary Examiner*—Peter Vo
*Assistant Examiner*—James P Calve

[57] ABSTRACT

The invention relates to an automatically driven pile-driver drilling device for drilling into the earth with a percussion piston moving axially inside a casing, driven by a pressure medium and changeable from a forward stroke to a backstroke, with a working space having radial control openings, a guide pipe with radial control openings extending into the working space and forming a rigid part of the housing, and a control box guided into an annular chamber of the guide tube and axially adjustable in a spring-pneumatic manner.

10 Claims, 7 Drawing Sheets

AUTOMATICALLY DRIVEN PILE DRIVER DRILLING DEVICE

BACKGROUND OF THE INVENTION

In order to produce drill holes in the ground or for the purpose of destroying and replacing pipelines placed in the ground, pile driver drilling devices are used, which have a percussion piston arranged inside the device that can be moved back and forth.

Pile driver drilling devices of this type have been exceptionally suitable for the trenchless placement of lines in the ground and for the replacement of pipelines in the ground by destroying and then replacing them. They require a change in direction in order to be able to produce, for example, blind holes, or in order to avoid the need for digging up a device restrained by an insurmountable obstacle in the ground, instead, being able to move out of the bore hole it already created by means of-reverse operation.

For a change in direction, numerous systems are known, all of which are based on the fact that the impact energy of the percussion piston, moving axially inside the housing of the device, is introduced into the housing of the device, not in the direction of advance, but in the opposite direction, with the aid of a rearward housing stop for the percussion piston. This takes place in a simple manner, whereby adjusting a control slide inside the housing of the device, whose control edges are displaced axially, determines the point at which the ventilation of the working space, located before the percussion piston in the area of the tip of the device, takes place. At that time the respective control edges are placed opposite the direction of advance, so that the working space is ventilated at a later point in time and, accordingly, the percussion piston with its rearward front surface impacts with a stop forming a rigid part of the housing.

The construction and mode of operation of the control slide vary greatly in practice. For example, the European Patent 484,839 describes a pile driver drilling device with a step pipe, extending into a rear working space of the percussion piston and forming a rigid part of the housing on which an axially adjustable control casing is mounted. Between the control casing and the housing wall is the axially guided percussion piston with its cover surrounding the rear working space.

In the interior of the control casing, between a stop on the operating air supply step pipe, and a collar of the control casing, a readjusting spring is located which, in cooperation with control air supplied via a channel parallel to the axis, sustains the control casing against the pressure of the operating air in the working space of the percussion piston when in its advance position.

If the interior of the control casing is ventilated, then the force resulting from the operating air inside the working space of the percussion piston exceeds the spring force opposing it, with the result that the operating air compresses the spring by moving the control casing into its rearward, or reverse position, from which position it can again return to its advance position with the aid of the control air and the readjusting spring.

With this changing of direction, it is a disadvantage that the percussion piston is guided directly on the control casing and that the readjusting spring is located in the interior of the control casing since the smallest diameter is therefore determined by the diameter of the readjusting spring. This restricts the outer diameter of the pile drilling device to a minimum value. An additional problem results when the spring breaks in the return position, which can easily occur during the great dynamic stress and the small amount of space, at which time a change in direction into the advance position, via the compressed air, is no longer possible. On the other hand, if the spring breaks in the advance position, the advance [movement] automatically changes to the return [reverse] position without the possibility of external control.

The axially moving control box is also in constant sliding contact with the interior wall of the piston. During increased friction, as occurs during contamination or insufficient lubrication, the control box can move back and forth since the slight forces for changing its direction are not sufficient for restraining the box axially. The same problem arises when an automatically driven pile driver drilling device locks up or bends, while passing through various soil layers inside the earth.

Finally, the control channel consists of two concentric pipes, requiring more radial space than when the control air is supplied through one or several radial bores. In particular, in the case of smaller devices, this is a great disadvantage since little space remains for exhaust air and air supply channels.

SUMMARY OF THE INVENTION

Among other things, the invention seeks to overcome those disadvantages which result from the control casing and the surface of the percussion piston working space coming in direct contact with each other.

For the solution of this task, the invention proposes a pile driver drilling device in which a guide pipe carrying compressed air extends into the rear working space of the percussion piston and is rigidly connected with the housing [and] on which the cover of the rear percussion piston working space is guided. Accordingly, in the area of its rear working space, the percussion piston is mounted on a section which is rigidly connected with the housing. The control slide is in the form of an axially displaceable control box, and is guided in an axially adjustable manner inside an annular space, consisting preferably of an inner and an outer pipe. This inner space and the control box may be provided with corresponding stops which determine at least one of the two working positions of the control box.

The inner pipe, the outer pipe and the control box may be provided with radial control openings which coincide with each other in groups during the forward stroke or backstroke.

In order to move the control casing into one of its two working positions or to hold it there, the control box may be under the influence of a pressure spring and/or a control air line in the form of a control air channel which may open into the annular space before the control box.

If the positive directions of the pressure spring and the control air oppose each other, then the control box may be adjusted with the aid of the control air opposing the pressure spring, which then operates as a readjusting spring for the control box when control air is no longer effective.

However, the control air and the spring also may have the same positive direction. In this case, the control air channel opens into a pressure chamber of the control box and the movement of the control box takes place with the aid of the control air and the pressure spring, and with the aid of the working air entering another pressure chamber of the control casing.

If the control air line extends through the guide pipe (8), then, in the event of a leak in the control air line instead of the control air, the working air or compressed air is effective with respect to the percussion piston. If the control box, under the influence of the control air, is located in its return position, then the working air holds the control casing in this position in the case of a leak. In the event of a leak, if the control air line is without pressure, and the control box is in its advance position, then the working air automatically forces the control box into its return position and the device moves out of the earth.

BRIEF DESCRIPTION OF THE DRAWINGS

In the following text, the invention is explained in greater detail with the aid of the examples shown in the drawing, wherein.

Figure 1:
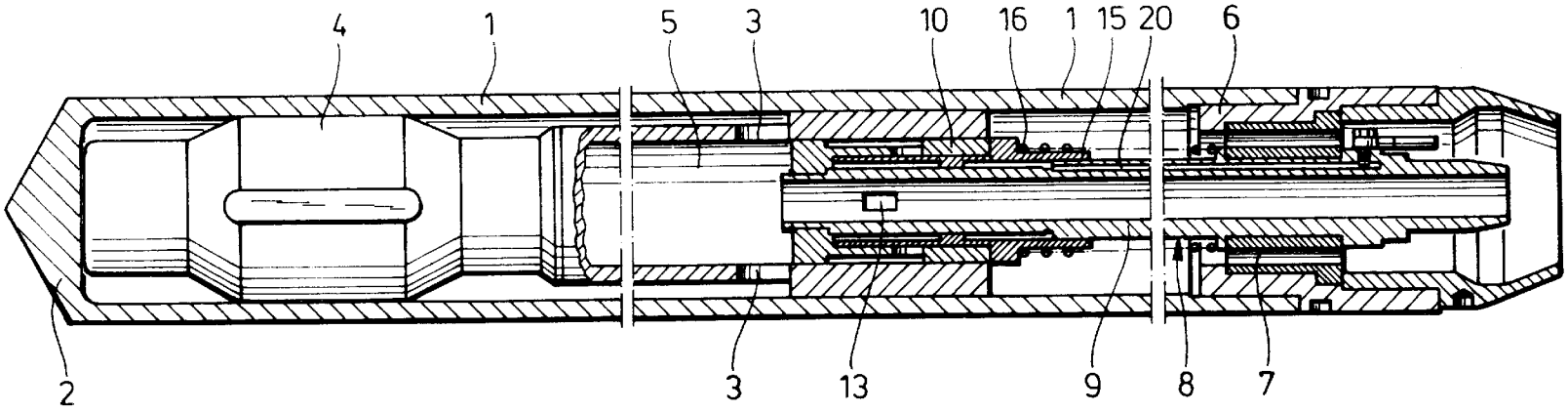
FIG. 1 shows a change in direction, in which the positive directions of the control air and of the pressure spring assume the same direction and the control box is in its advance position.

The pile driver drilling device consists of a cylindrical housing (1) with an impact point (2) and a percussion piston (4), provided with radial control openings (3), in whose rearward part is located a rear working space (5). In the rearward part of the housing (1), a stop ring (6), with ventilation openings (7) parallel to the axis, is built in.

Through the stop ring (6) extends a guide pipe (8) which, on the one end, is connected with a working air or compressed air hose (not shown), and on the other end, extends with its front end into the working space (5) of the percussion piston (4). The guide pipe (8) consists of an inner pipe (9) and a shorter outer pipe (10), between which an annular space (11) is located, with a bore (12), such as a front bore, opening into the working space (5). The inner pipe (9) has one or several radial control openings (13), and the outer pipe has radial control openings (14). Into the annular chamber (11), an axially adjustable control box (15) extends, which is guided between a pressure spring (16), and a stop at the inner pipe (9).

The control box (15) has radial control openings (17), as well as a front pressure chamber (18), connected with the inner pipe (9), carrying compressed air via the control opening (13), and a pressure chamber (19), which is connected via a control air line in the form of a control air channel (20) in the inner pipe wall, and a valve (not shown), is connected with a control air source. Furthermore, the control box has a stop edge (21), and an interior stop collar (22), while the inner pipe (9) is provided with a stop collar (23). Furthermore, the outer pipe is provided with an outer recess (24).

In the position of advance (FIG. 2), the compressed air supplied via a hose flows through the inner pipe (9) into the rear working space (5) of the percussion piston (4), and via its control openings (3), reaches the front working space located between the impact point and the percussion piston, with the result that the percussion piston is displaced in a backward direction, or in the direction toward the stop ring (6) until its control openings (3) pass over the stop edge (21). Accordingly, the front working space is suddenly ventilated and the direction of movement of the percussion piston (4) is suddenly reversed under the influence of the compressed air entering through the guide pipe (8) into the working space (5), so that finally its energy is surrendered during impact with the impact point (2). This action is repeated as long as the control box (15) remains under the influence of the pressure spring (16) and under the control air supplied via the channel (20) into its rear pressure chamber (19), in its position of advance (FIG. 2).

Figure 3:
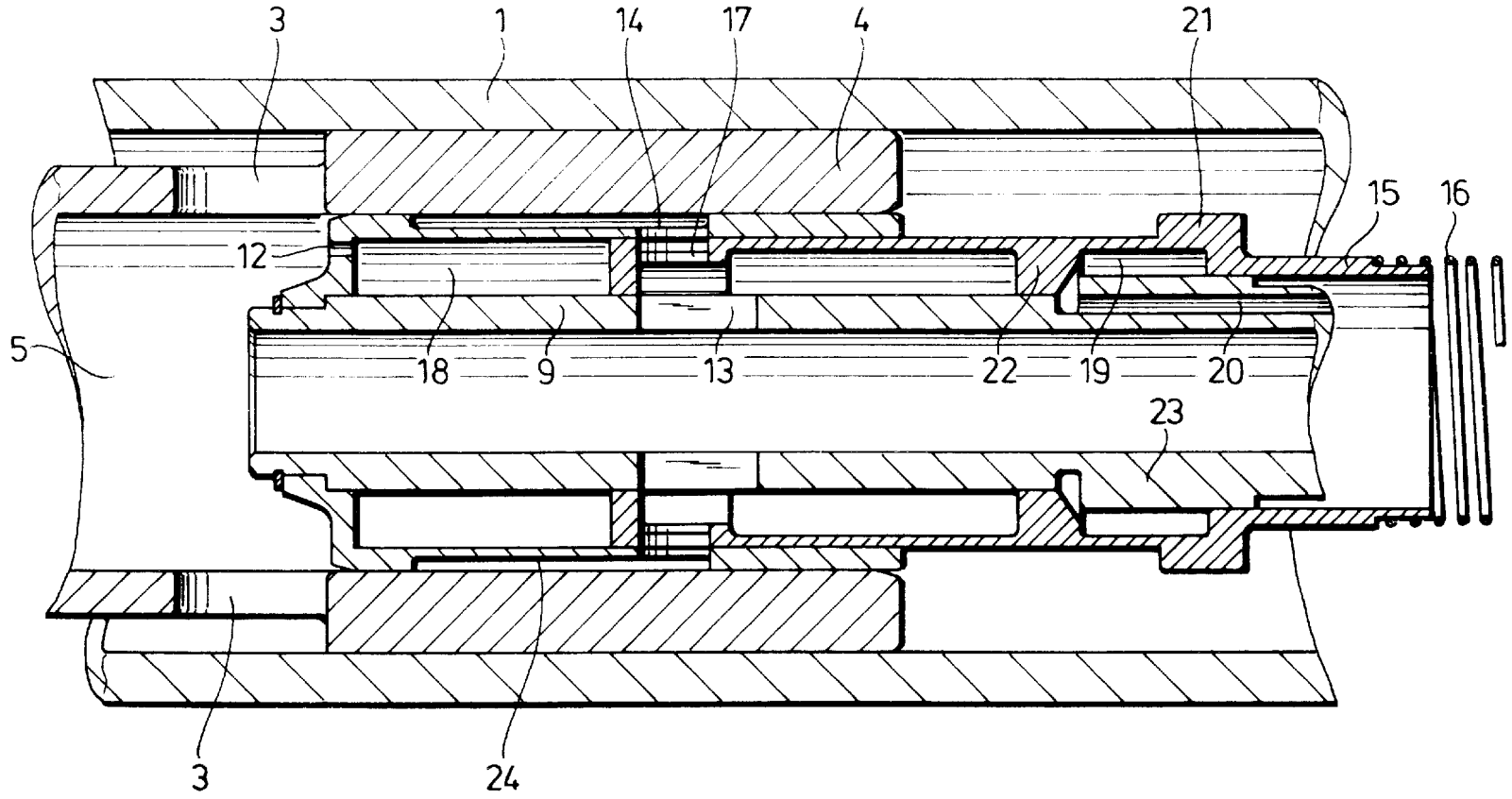
FIG. 3 shows a representation corresponding to FIG. 2, however with the control box in its return position.

In order to reverse the direction of movement of the pile driver drilling device, the rear pressure chamber (19) of the control box (15) is ventilated, and the compressed air, present via the bore (12) in front of the control box, in the front pressure chamber (18) and in the working space (5), moves the control box (15) against the force of the pressure spring (16) into the return position (FIG. 3). In this position, the radial control openings (13, 14, 17) of the inner and outer pipe (9, 10), as well as of the control box (15), align with the result that via these control openings, compressed air reaches the front working space even when the radial control openings (3) of the percussion piston (4) are located in the area of the recess (24). Accordingly, the percussion piston front surface is charged with compressed air until finally its control openings (3) pass across the stop edge (21), and the compressed air can flow off via the annular space surrounding the guide pipe (8) behind the control box and the ventilation bores (7), and the percussion piston with its rearward front surface impacts with the stop ring (6) in order to surrender its impact energy into this point.

As soon as control air reaches the pressure chamber (19) of the control box (15) via the channel (20), same moves in the direction of advance under the influence of the pressure spring (16) and of the control air, against the effect of the compressed air present in the front pressure chamber (18), and via the front bore (12) inside the annular space (11) in front of the control box, until the stop edge (21) impacts with the outer pipe (10) and the advance position (FIG. 2) has been attained.

Figure 2:
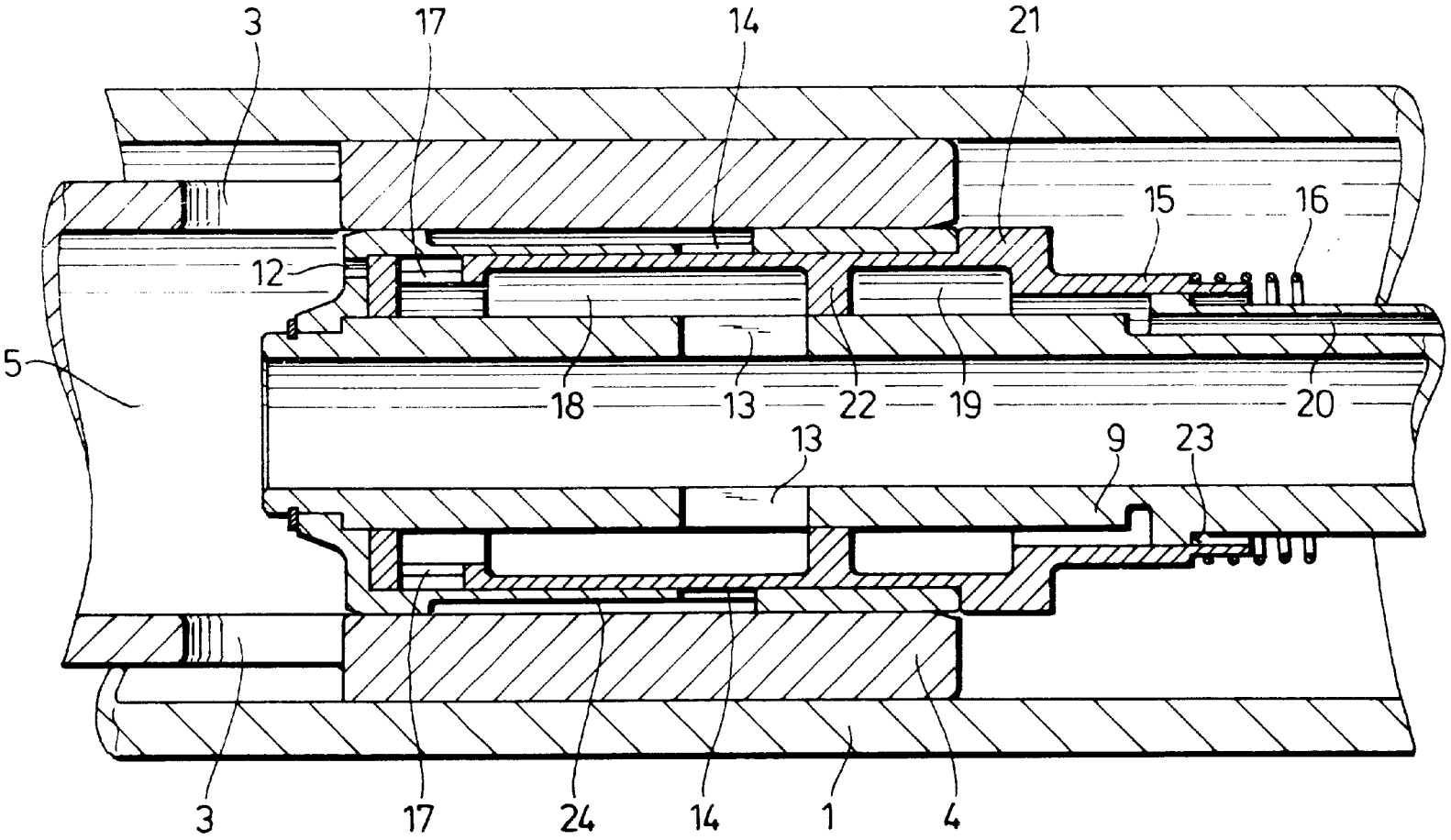
FIG. 2 shows an enlarged representation of the rearward portion of the pile driver drilling device, similar to FIG. 1, with the front portion of the guide pipe and the control box in their advance position.
Figure 4:
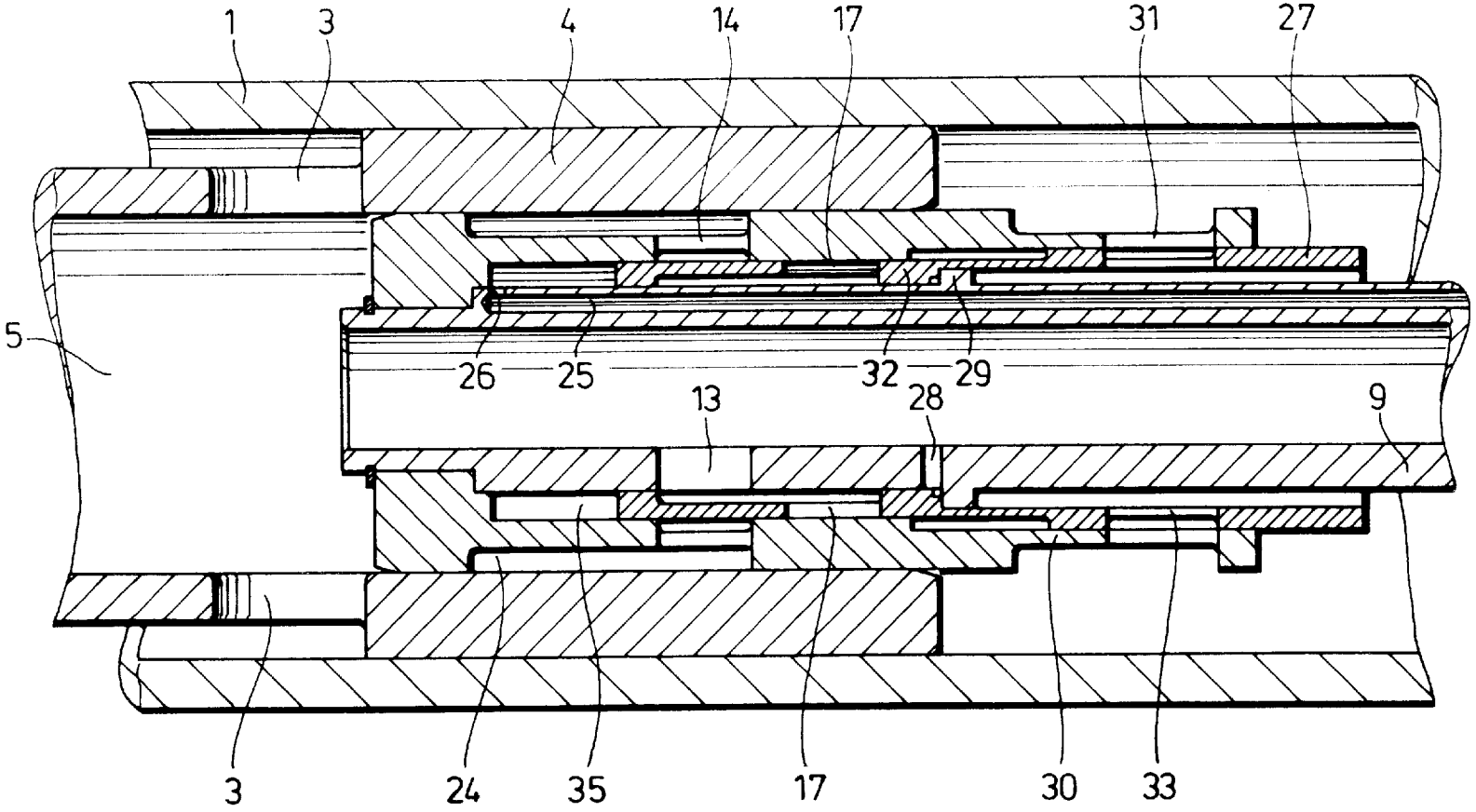
FIG. 4 shows a change in direction in accordance with the invention with a control box in its advance position which is charged by means of the compressed control air, and by compressed operating air.
Figure 5:
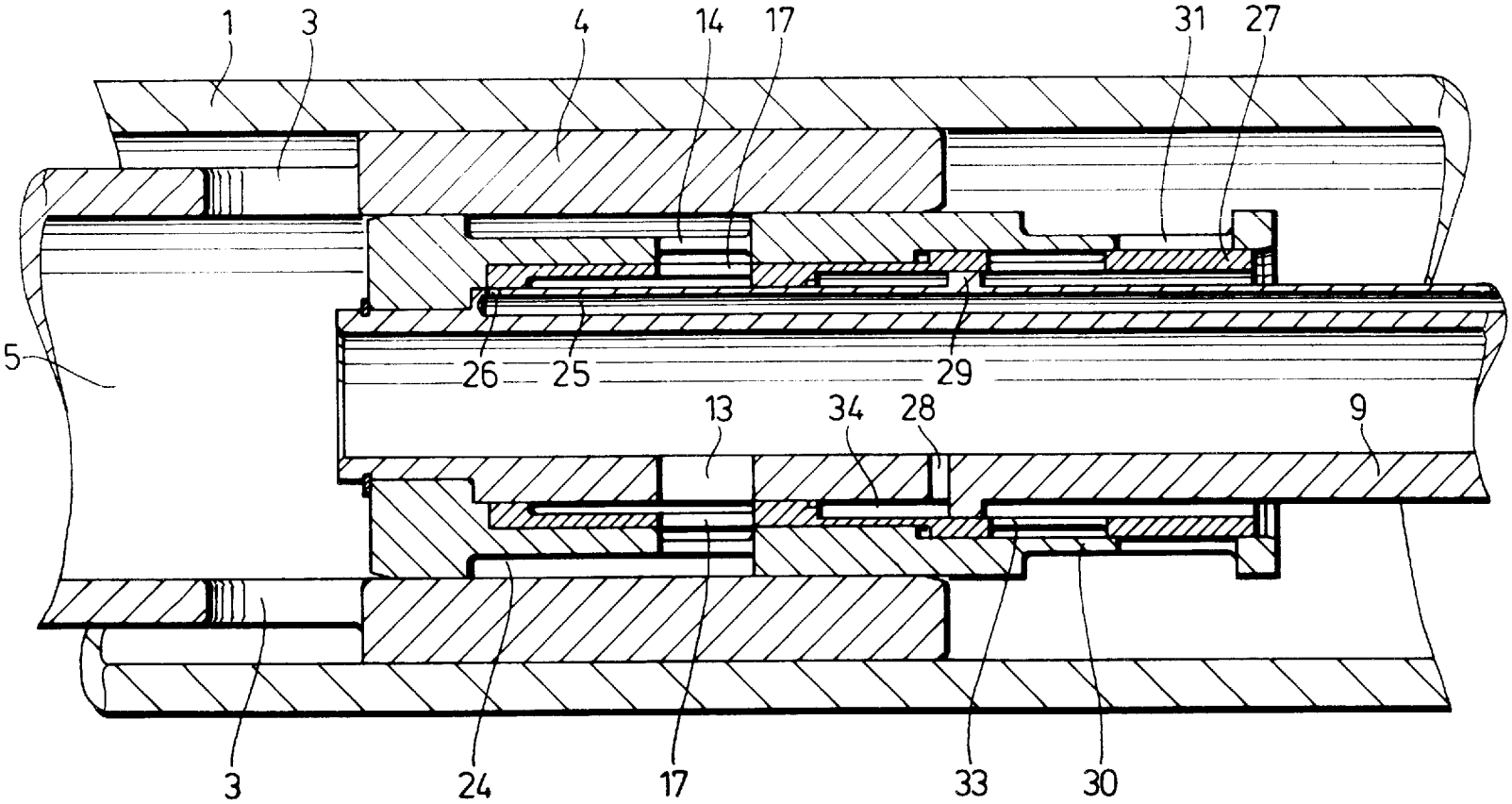
FIG. 5 shows a representation corresponding to FIG. 4, however with the control box in its return position.

In contrast to the example of FIGS. 1 to 3, during the change in direction in accordance with FIGS. 4 and 5, a control air channel (25) extends with an outlet opening (26) into a pressure chamber (35) in the front part of the annular space (11), and located in a control box (27), and the inner pipe (9) is provided with a radial bore (28) as well as with a collar (29) functioning as a stop. The outer pipe has an additional recess (30) with radial control openings (31), while the control box (27) is provided with an inwardly directed impact ring (32), as well as additional rear control openings (33), which open into the rearward portion of the annular space (11).

In the advance position (FIG. 4), the working space before the percussion piston (4) is ventilated suddenly when the control openings (3) of the percussion piston (5) reach the area of the rear recess (30) of the outer pipe (10), and the compressed air can flow from the front work space via the control openings (3, 31, 33), as well as the rear portion of the annular space (11), and the direction of movement of the percussion piston is reversed under the influence of the pressure build-up in the rear working space (5).

In order to move the control box (27) into its return position (FIG. 5), the pressure chamber (35), in that part of the annular space (11) which is located before the control box, is ventilated via the control air channel (25), so that the force of the compressed operating air, entering via the opening (28) into a pressure chamber (34), is sufficient for bringing the control box into the return position (FIG. 5). Then, the control openings (13, 14, 17) are aligned in the inner and outer pipe (9, 10), as well as in the control box (27), so that the working space before the percussion piston (4), as described in connection with the FIGS. 1 to 3, continues to be supplied with compressed air, when the control openings (3) of the percussion piston (4) reach the area of the front recess (24) of the outer pipe (10).

The radial bore (28) serves for supplying the pressure chamber (34) continuously with the compressed operating air of the pile driver drilling device. Thus, if the control air channel (25) is ventilated, the pressure chamber (35) pushes the control slide (27) into the return position.

The effective area in the chamber (34), which is charged with compressed air, is smaller than that of the chamber (35), whereby a displacement then becomes possible. This change in direction takes place purely pneumatically, without a pressure spring (16).

The two examples distinguish themselves from each other in that with the example of FIGS. 1 to 3, the control air and the pressure spring (23) are effective in the same direction, and, accordingly, the control box (15) is located during the advance in its front position (FIGS. 1, 2), and during the return in its rearward position (FIG. 3). In contrast, the control air in the example of FIGS. 4 and 5 is effectively opposite to the direction of advance of the pile driver drilling device, so that the control box (27) is located during the advance in its rearward position (FIG. 4), and during the return, in its front position (FIG. 5). However, in both cases, the reversal of movement of the pile driver drilling device is brought about in that a control air valve is operated, and a control box, which is enclosed with respect to the percussion piston, is moved from one working position to the other one.

Figure 6:
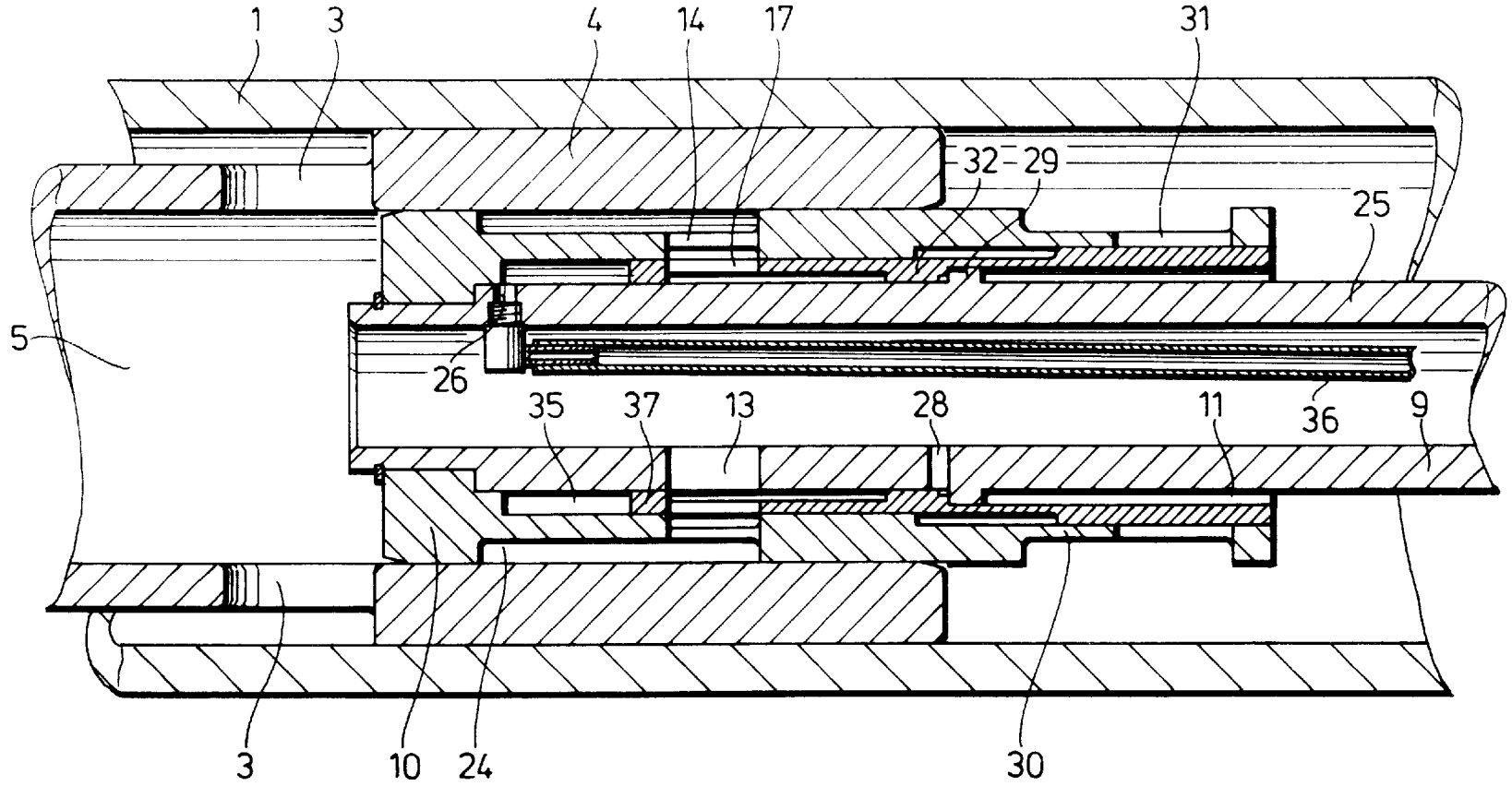
FIG. 6 shows a change in direction which, in the case of a control air outage, is always in the shown return position.
Figure 7:
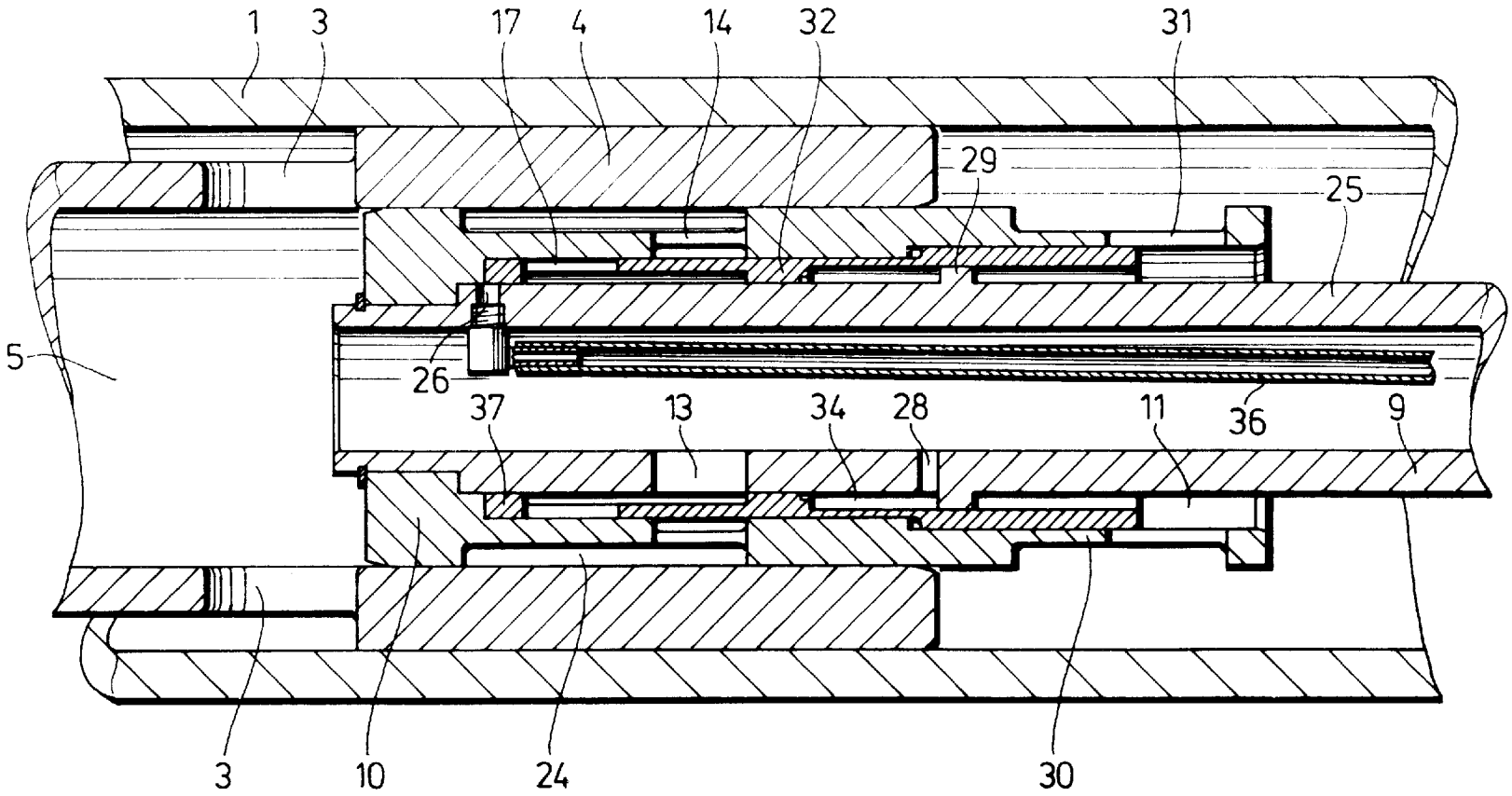
FIG. 7 shows the change in direction of FIG. 6 in the advance position.

The change in direction of FIGS. 6 and 7 distinguishes itself from the change in direction of FIGS. 5 and 6 in that the control air enters the pressure chamber (35) through a control air hose (36) extending inside the inner pipe (9). Furthermore, the control box (37) has only front control openings (17), while the control box (27) has front control openings (17) and rear control openings (33). The omission of the rear control openings (33) causes the control box (37), during the reverse run, to be located in the rear (FIG. 6), and during the forward run, to be located in the front working position (FIG. 7). Since, in the case of a leak inside the control air hose (36), same is under the influence of the working or compressed air inside the inner pipe (9), and, during a leak, the control box (37) always moves into its return position.

What is claimed is:

1. An automatically operated pile driver drilling device for producing bore holes in the ground, comprising:

a housing comprising an outer casing;

a percussion piston having an impact head and being axially movable within the casing and having a direction of movement that can be changed from a forward stroke to a rearward stroke, the piston defining an interior working space and having a first radial control opening that communicates the working space with the exterior of the piston;

a guide pipe rigidly connected to the housing and extending into the working space of the piston for providing working air to the piston, the guide pipe being provided with at least one second radial control opening;

a control slide mounted on an outer surface of the guide pipe and inwardly of the piston, the control slide being axially movable with respect to the guide pipe, whereby the extent of movement of the piston in the forward and rearward directions is controlled by the axial position of the control slide; and a control-air source for controlling the position of the control slide, the control slide and the guide pipe defining a first pressure chamber in communication with the control-air source, wherein the control slide and the guide pipe define a second pressure chamber at a position forward of the first pressure chamber the second radial control opening of the guide pipe being in communication with the second pressure chamber when the control slide is in a forward position toward said impact head of said percussion piston.

2. A device in accordance with claim 1, wherein the guide pipe and the control slide comprise stops that limit the degree of movement of the control slide.

3. A device in accordance with claim 1, further comprising a pressure spring acting on the control slide in a same direction as a pressure exerted by the controlled air.

4. A device in accordance with claim 1, wherein the guide pipe comprises concentric inner and outer members with the control slide being disposed between the inner and outer members, and an opening is provided for communication between the working space of the piston and a space defined between the inner and outer members forward of the control slide.

5. A device in accordance with claim 1, wherein the control air is provided through a control air line that passes within the guide pipe.

6. An automatically operated pile driver drilling device for producing bore holes in the ground, comprising:

a housing comprising an outer casing;

a percussion piston axially movable within the casing and having a direction of movement that can be changed from a forward stroke to a rearward stroke, the piston defining an interior working space and having a first radial control opening that communicates the working space with the exterior of the piston;

a guide pipe rigidly connected to the housing and extending into the working space of the piston for providing working air to the piston, the guide pipe being provided with at least one second radial control opening;

a control slide mounted on an outer surface of the guide pipe and inwardly of the piston, the control slide being axially movable with respect to the guide pipe, whereby the extent of movement of the piston in the forward and rearward directions is controlled by the axial position of the control slide; and a control-air source for controlling the position of the control slide, the control slide and the guide pipe defining a first pressure chamber in communication with the control-air source, wherein the guide pipe includes concentric inner and outer members, with the control slide being disposed between the inner and outer members.

7. A device in accordance with claim 6, wherein the inner member, the outer member, and the control slide are provided with radial control openings that are in communication with each other at different times during operation of the device.

8. A device in accordance with claim 6, wherein the outer member comprises a recessed portion on an outer surface thereof.

9. An automatically operated pile driver drilling device for producing bore holes in the ground, comprising:

a housing comprising an outer casing;

a percussion piston axially movable within the casing and having a direction of movement that can be changed from a forward stroke to a rearward stroke, the piston defining an interior working space and having a first radial control opening that communicates the working space with the exterior of the piston;

a guide pipe rigidly connected to the housing and extending into the working space of the piston for providing working air to the piston, the guide pipe being provided with at least one second radial control opening;

a control slide mounted on an outer surface of the guide pipe and inwardly of the piston, the control slide being axially movable with respect to the guide pipe, whereby the extent of movement of the piston in the forward and rearward directions is controlled by the axial position of the control slide, wherein the control slide is provided with forward control openings; and a control-air source for controlling the position of the control slide, the control slide and the guide pipe defining a first pressure chamber in communication with the control-air source, wherein the control air is provided through a control air line that passes within the guide pipe.

10. A device in accordance with claim 9, wherein the guide pipe comprises concentric inner and outer members with the control slide being disposed between the inner and outer members, and the outer member comprises control openings located at a position to the rear of the control slide when the control slide is in a forward position.

* * * * *